US012090416B2

(12) United States Patent
Nirwan

(10) Patent No.: US 12,090,416 B2
(45) Date of Patent: Sep. 17, 2024

(54) ASSEMBLED SLIDE

(71) Applicant: Crowntec (Jiang Xi) Sports Technology Co. Ltd., Jiujiang (CN)

(72) Inventor: Soebagiyo Nirwan, Jiujiang (CN)

(73) Assignee: CROWNTEC (JIANG XI) SPORTS TECHNOLOGY CO. LTD., Jiujiang (CN)

( * ) Notice: Subject to any disclaimer, the term of this patent is extended or adjusted under 35 U.S.C. 154(b) by 170 days.

(21) Appl. No.: 17/879,496

(22) Filed: Aug. 2, 2022

(65) Prior Publication Data

US 2024/0042336 A1 Feb. 8, 2024

(51) Int. Cl.
*A63G 21/18* (2006.01)

(52) U.S. Cl.
CPC ..... *A63G 21/18* (2013.01)

(58) Field of Classification Search
None
See application file for complete search history.

(56) References Cited

U.S. PATENT DOCUMENTS 4,270,748 A * 6/1981 Ray ..... A63G 21/00 403/337
4,299,171 A * 11/1981 Larson ..... A63G 3/02 472/117
4,712,264 A * 12/1987 Voith ..... A61G 3/061 193/41
4,932,648 A * 6/1990 Ahrens ..... A63G 21/00 104/70
4,943,048 A * 7/1990 Hentges ..... A63G 21/00 182/49
5,860,867 A * 1/1999 Van Deusen ..... A63G 21/00 472/88
7,758,434 B1 * 7/2010 Johnson ..... A63G 21/18 472/117
8,105,173 B2 * 1/2012 Connors ..... A63G 31/00 472/117
8,651,970 B2 * 2/2014 Chen ..... A63G 21/02 472/117
9,308,460 B1 * 4/2016 Chin ..... A63G 21/04
10,549,206 B1 2/2020 Nirwan
11,684,861 B2 * 6/2023 Chen ..... A63G 21/02 472/116

(Continued)

FOREIGN PATENT DOCUMENTS

CN 201783191 U * 4/2011
CN 201832416 U 5/2011

(Continued)

*Primary Examiner* — Joseph A Dillon, Jr.
(74) *Attorney, Agent, or Firm* — MUNCY, GEISSLER, OLDS & LOWE, P.C.

(57) ABSTRACT

An assembly slide defined with a front and a back, and two sides of the front provided with a retaining wall. The assembly slide comprises at least two sub-units that are sequentially lapped with each other and a water supply member. Each of the two sub-units comprises two ends, and at least one lapping portion disposed on one of the two ends, a lapped gap is formed after the two sub-units are lapped with each other by two lapping portions. The water supply member comprises a water outlet end exposed on the front and disposed adjacent to the lapped gap, and a water inlet end disposed on the back and connected to a water supply pipe.

8 Claims, 7 Drawing Sheets

(56) References Cited

U.S. PATENT DOCUMENTS

| | | | | |
|---|---|---|---|---|
| 2015/0197899 | A1* | 7/2015 | Welch | E01C 5/005 404/40 |
| 2019/0119922 | A1* | 4/2019 | Winter | E04F 11/002 |

FOREIGN PATENT DOCUMENTS

| | | | | | |
|---|---|---|---|---|---|
| CN | 201848096 | U | * | 6/2011 | |
| CN | 105289006 | A | | 2/2016 | |
| CN | 103505877 | B | | 12/2016 | |
| CN | 205964981 | U | * | 2/2017 | |
| CN | 217908933 | U | * | 11/2022 | |
| EP | 3685895 | A1 | * | 7/2020 | A63G 21/00 |
| GB | 2536292 | A | * | 9/2016 | A63G 21/04 |

* cited by examiner

ASSEMBLED SLIDE

FIELD OF THE INVENTION

The invention relates to an assembled slide, and more particularly to an assembled slide capable of implementing as a slide or a water slide.

BACKGROUND OF THE INVENTION

CN201832416U, CN103505877B and US10, 549, 206 disclose a slide structure respectively, but the previous disclosed patents only provide a slide structure for sliding only. If the user would like to have water flowing on the slide for having much fun, the easiest way is to place a water pipe on the slide. However, the water pipe will affect the smoothness of the slide, and the water pipe is not fixed, resulting in a poor water flow effect. Although this problem can be solved by means of a structure for hanging the water pipe, the structure for hanging can be easily damaged by children to change the water supply state of the water pipe when the children get too excited in having fun.

Although CN105289006A discloses a design with a water outlet disposed on the slide, the water outlet is sunken on the slide, which affects the overall smoothness of the slide to some extent and causes poor user experience.

SUMMARY OF THE INVENTION

A main object of the invention is to solve the problem of affecting an overall smoothness of a conventional slide when it is additionally disposed with a structure for sliding.

In order to achieve the above object, the invention provides an assembly slide defined with a front and a back, and two sides of the front provided with a retaining wall. The assembly slide comprises at least two sub-units sequentially lapped with each other, and a water supply member, wherein each of the at least two sub-units comprises two ends, and at least one lapping portion disposed on one of the two ends, and wherein a lapped gap is formed after the at least two sub-units lapped with each other by two lapping portions thereof, and wherein the water supply member comprises a water outlet end exposed on the front and adjacent to the lapped gap, and a water inlet end disposed on the back and connected to a water supply pipe.

In one embodiment, one of the two lapping portions at one of the at least two sub-units as a part of the back comprises an installation space communicated with the lapped gap and disposed of the water supply member.

In one embodiment, one of the two lapping portions at one of the at least two sub-units as a part of the back comprises a middle plate and two side plates respectively located on two sides of the middle plate, and the installation space is formed on the middle plate.

In one embodiment, each of the two side plates comprises a positioning groove, and the other one of the two lapping portions at the other one of the at least two sub-units as a part of the front comprises at least two positioning blocks matched with two positioning grooves of the two side plates.

In one embodiment, each of the middle plate and the two side plates comprises a first installation hole, and the other one of the two lapping portions at the other one of the at least two sub-units as a part of the front comprises a plurality of second installation holes matched with the first installation holes of the middle plate and the two side plates.

In one embodiment, one of the two lapping portions at one of the at least two sub-units as a part of the back comprises two first grooves, and each of the two first grooves is located between one of the two side plates and the middle plate, and wherein the other one of the two lapping portions at the other one of the at least two sub-units as a part of the front comprises two second grooves corresponding to the two first grooves respectively.

In one embodiment, lengths of the at least two sub-units are different, and one of the at least two sub-units with a longer length comprises a plurality of support ribs located on the back.

In one embodiment, the other one of the two sub-units with a shorter length comprises a ladder mounting slot.

Accordingly, compared with the prior art, the invention has the following features: the invention makes the water outlet end of the water supply member to be located at the lapped gap on the front of the assembly slide in order to solve the problem in the prior art caused by the need for an additional hole provided for disposal of the water supply member and to improve a user experience.

DETAILED DESCRIPTION OF THE PREFERRED EMBODIMENTS

Figure 1:
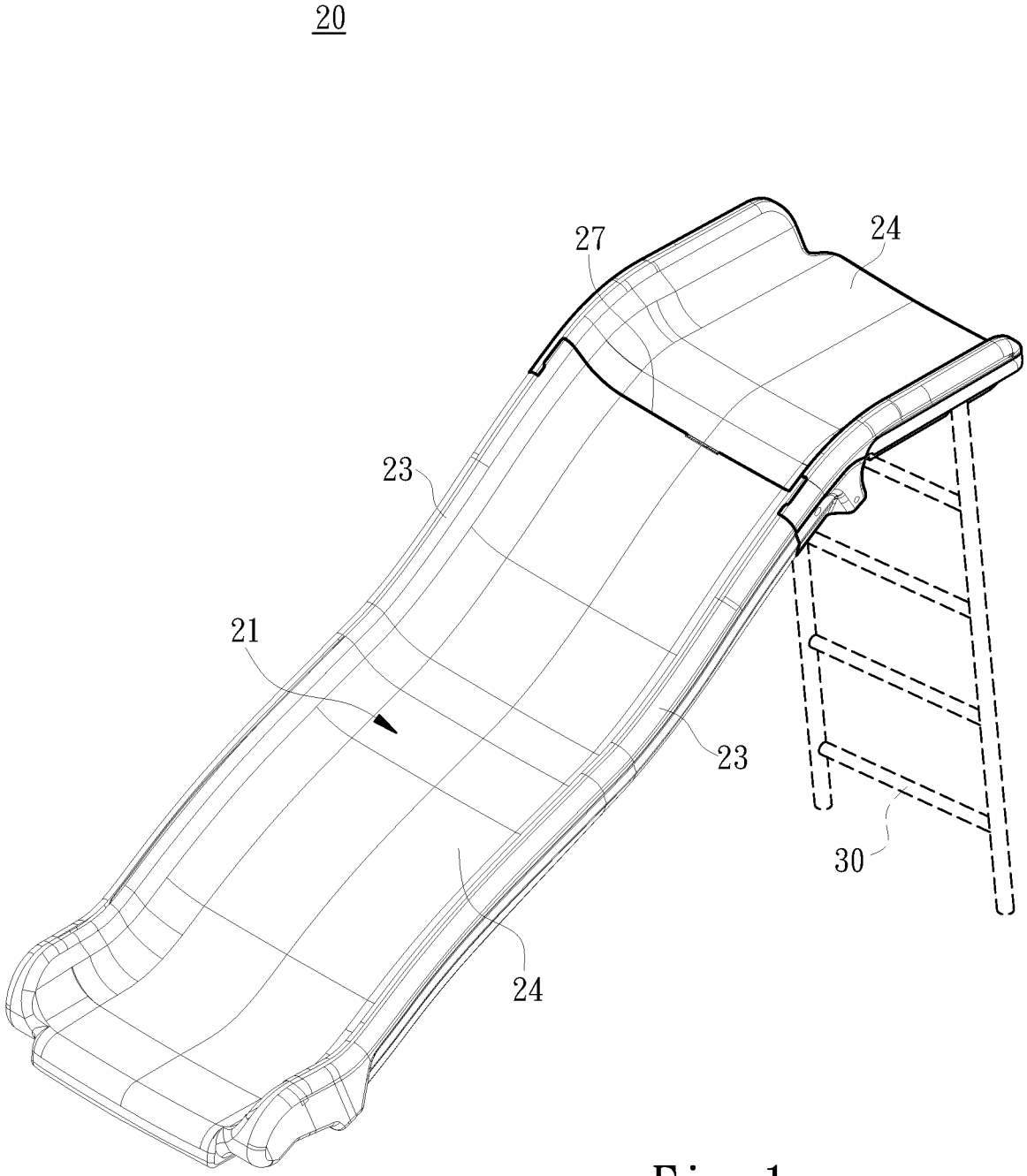
FIG. 1 is a perspective structural view of an assembled slide of one embodiment of the invention.

The detailed description and technical content of the invention are described below with reference to the accompanying drawings.

Please refer to FIG. 1, FIG. 2, FIG. 3, FIG. 4, FIG. 5, FIG. 6 and FIG. 7, the invention provides an assembly slide 20 defined with a front 21 and a back 22, and two sides of the front 21 are provided with a retaining wall 23, respectively. The assembly slide 20 comprises at least two sub-units 24 and a water supply member 26, and each of the at least two sub-units 24 includes two ends 241 and at least one lapping portion 242 disposed on one of the two ends 241. The at least two sub-units 24 are sequentially lapped with each other by the lapping portions 242 thereof, and a lapped gap 27 is formed after the lapping portions 242 of the at least two sub-units 24 are lapped with each other, and the lapped gap 27 communicates with the front 21 and the back 22 in a crooked manner. On the other hand, the water supply member 26 has a water outlet end 261 exposed on the front 21 and adjacent to the lapped gap 27, and a water inlet end 262 disposed on the back 22. Although the water outlet end 261 of the water supply member 26 can be directly observed from the front 21, the water outlet end 261 does not protrude from a surface of the front 21. Also, the water inlet end 262 can be connected to a water supply pipe 28.

The assembly slide 20 of the invention can be implemented with a ladder 30 (as shown in FIG. 1) or leaning against an object in an inclined manner. When the water supply member 26 of the assembly slide 20 is not connected to a water source, the assembly slide 20 can be used as a slide. When the water supply member 26 is connected to the water source via the water supply pipe 28, water will flow to the front 21 so that the assembly slide 20 can be used as a waterslide.

Please refer to FIG. 2, FIG. 3, FIG. 4, FIG. 5 and FIG. 6, the lapping portion 242 at one of the two sub-units 24 as a part of the back 22 comprises an installation space 243 communicated with the lapped gap 27 and disposed of the water supply member 26 therein. The installation space 243 penetrates through the lapping portion 242 at one of the two sub-units 24 as a part of the back 22 so that the water supply member 26 can be installed from the back 22. In one embodiment, the lapping portion 242 at one of the two sub-units 24 as a part of the back 22 comprises a middle plate 244 and two side plates 245 respectively located on two sides of the middle plate 244, and the installation space 243 is formed on the middle plate 244. On the other hand, the lapping portion 242 at other one of the two sub-units 24 as a part of the front 21 comprises a notch 24, wherein the notch 24 is formed on an edge of one of the two ends 241 of the sub-unit 24. After the two sub-units 24 are lapped with each other, the notch 246 is located at an axis same as the installation space 243, and a part of the water outlet end 261 of the water supply member 26 is accommodated in the notch 246. That is, one part of the water outlet end 261 of the water supply member 26 is located in the notch 246, and other part of the water outlet end 261 of the water supply member 26 is located in the lapped gap 27. In the invention, the water supply member 26 is installed into the installation space 243 from the back 22, a part of the water supply member 26 protrudes from one of the two lapping portion 242 at one of the at least two sub-units 24 as a part of the back 22 and is inserted into the lapped gap 27 such that the water outlet end 261 can be directly observed from the front 21. In one embodiment, each of the middle plate 244 and the two side plates 245 comprises a first installation hole 247, and the lapping portion 242 at other one of the two sub-units 24 as a part of the front 21 comprises a plurality of second installation holes 248 matched with the first installation holes 247 of the middle plate 244 and the two side plates 245. The plurality of second installation holes 248 are not communicated with the front 21 such that a plurality of connectors 29 for assembling the first installation holes 247 and the plurality of second installation holes 248 cannot be directly observed from the front 21.

Figure 2:
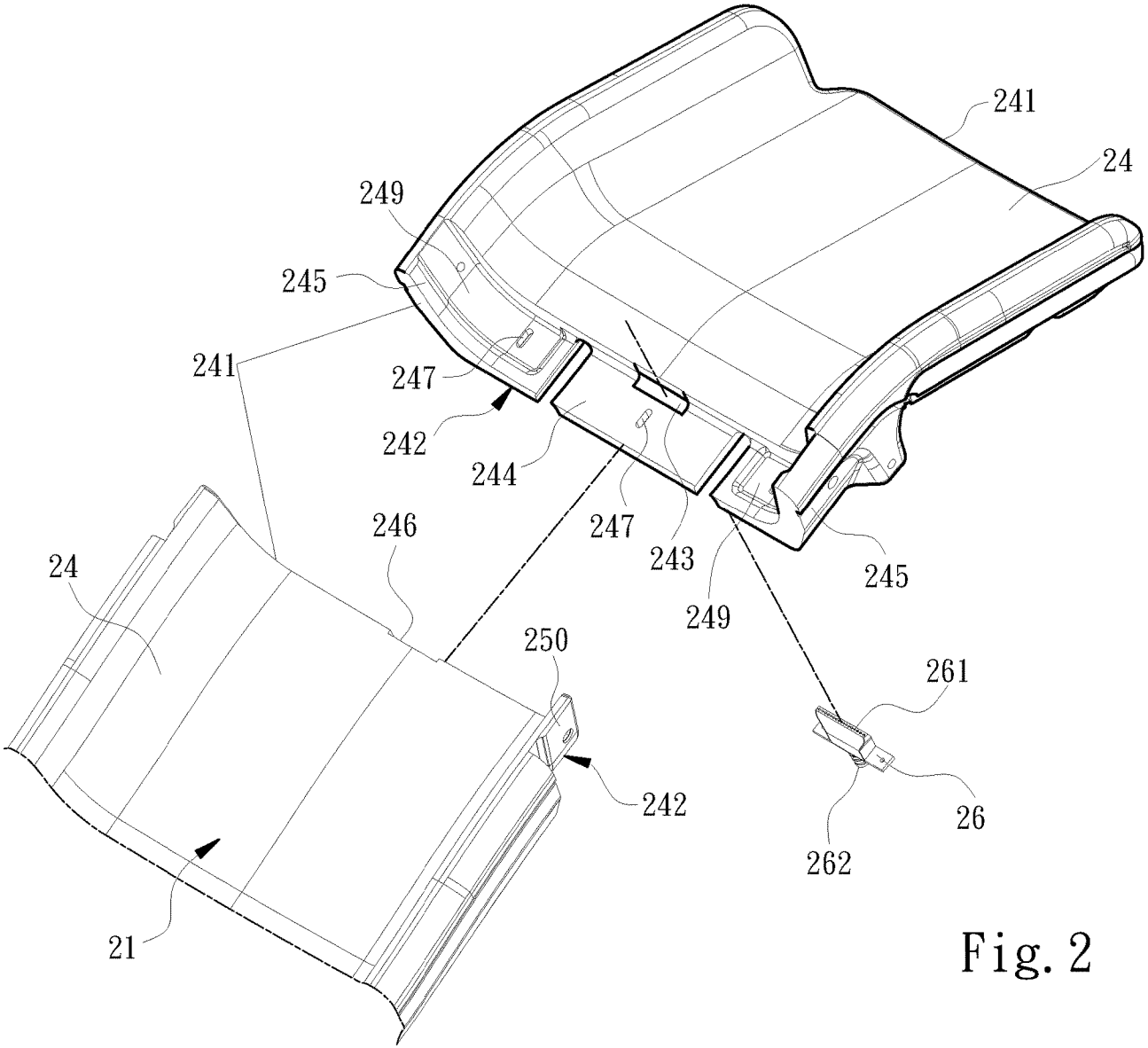
FIG. 2 is a first perspective exploded structural view of the assembled slide of one embodiment of the invention.
Figure 3:
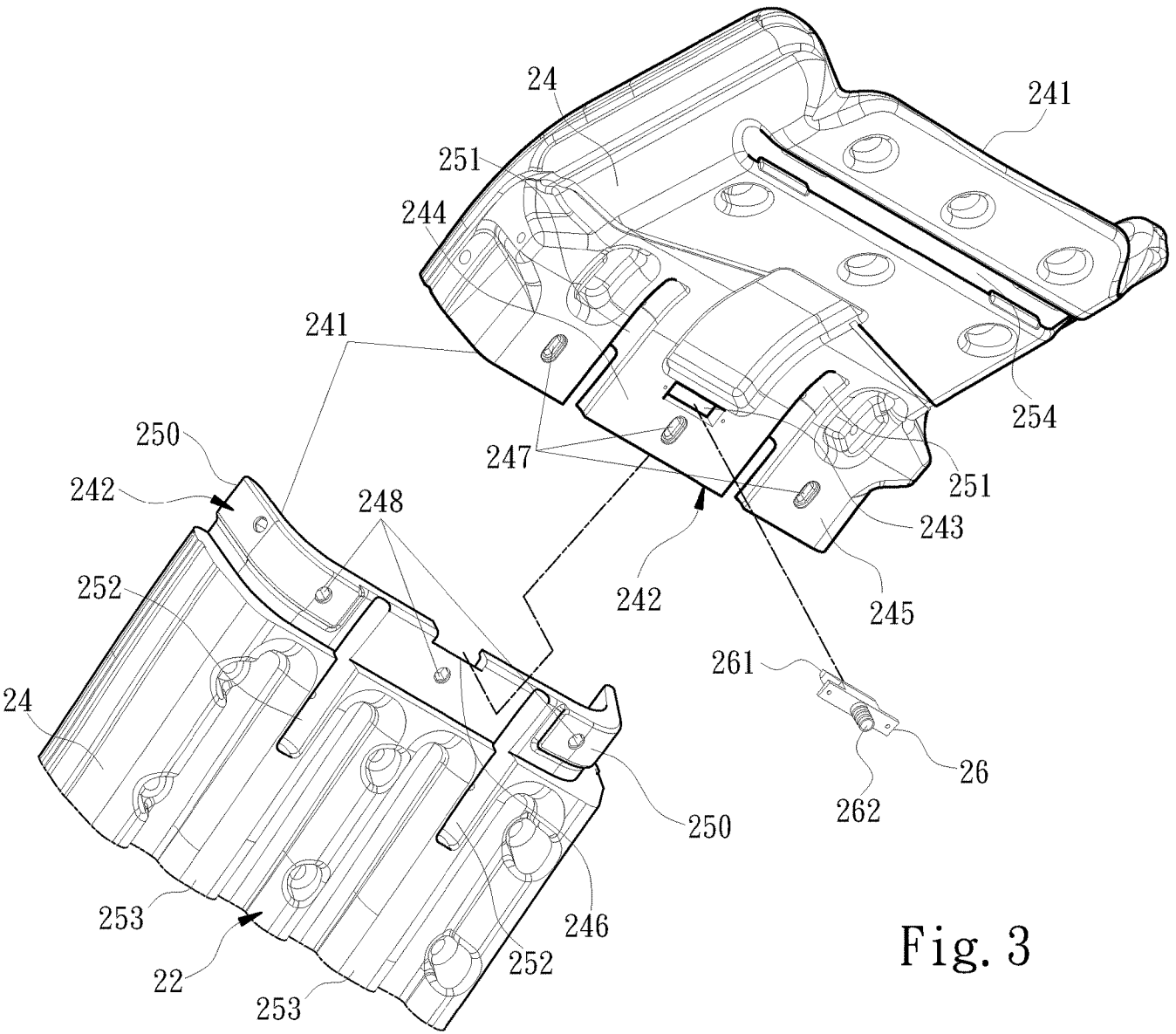
FIG. 3 is a second perspective exploded structural view of the assembled slide of one embodiment of the invention.
Figure 4:
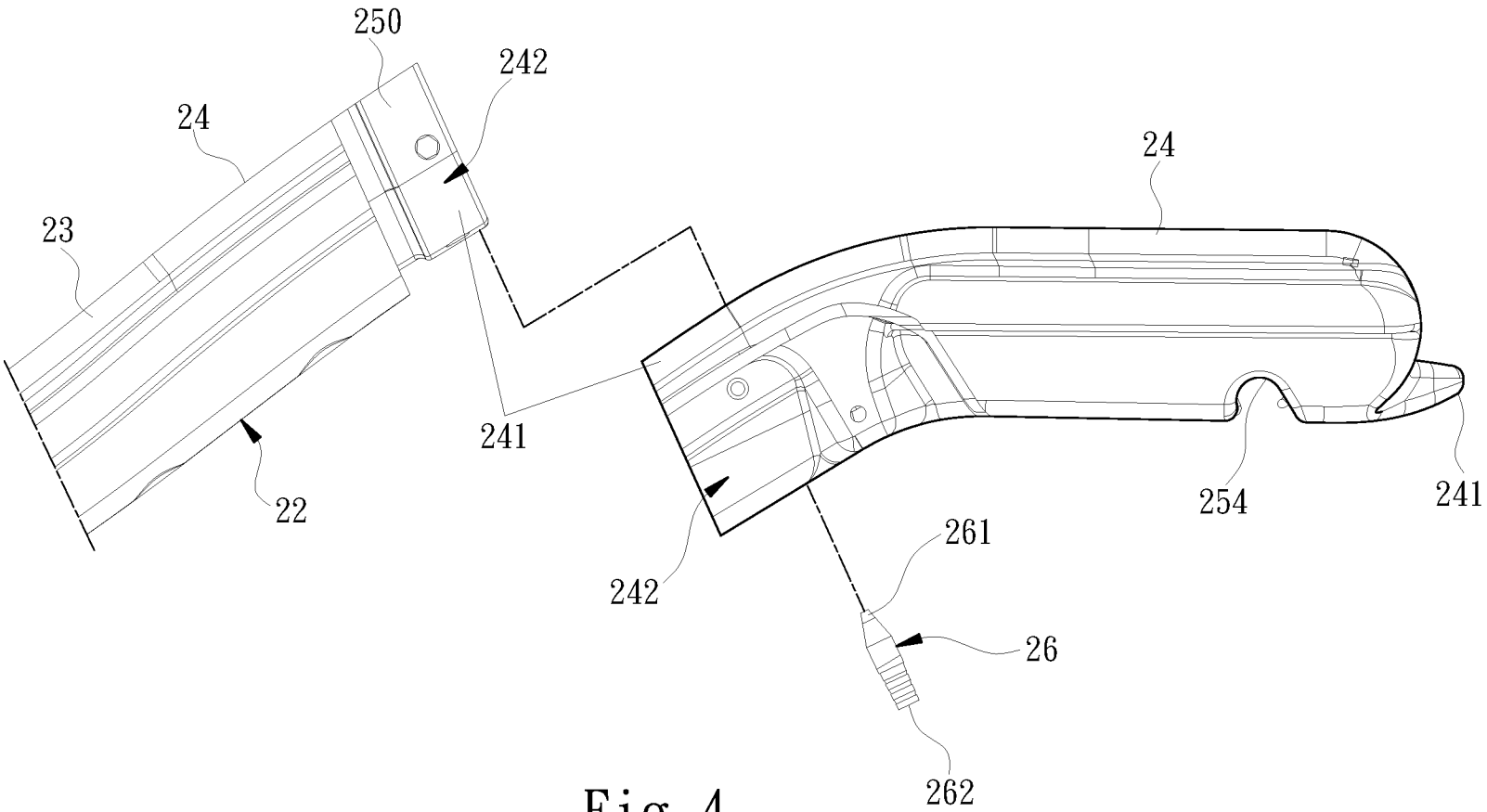
FIG. 4 is an exploded schematic side view of a partial structure of the assembled slide of one embodiment of the invention.
Figure 5:
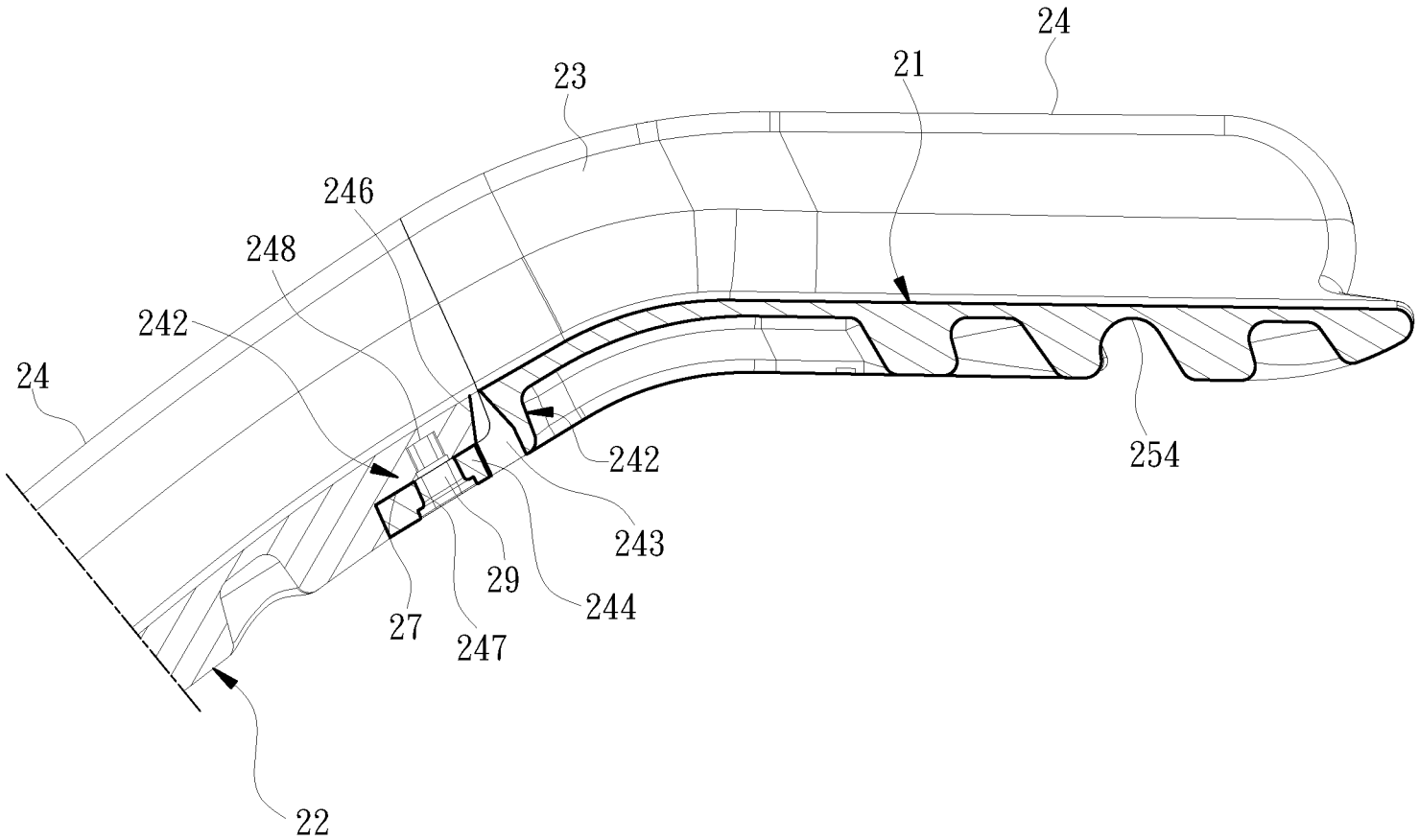
FIG. 5 is a cross-sectional view of a partial structure of the assembled slide of one embodiment of the invention without a water supply member.
Figure 6:
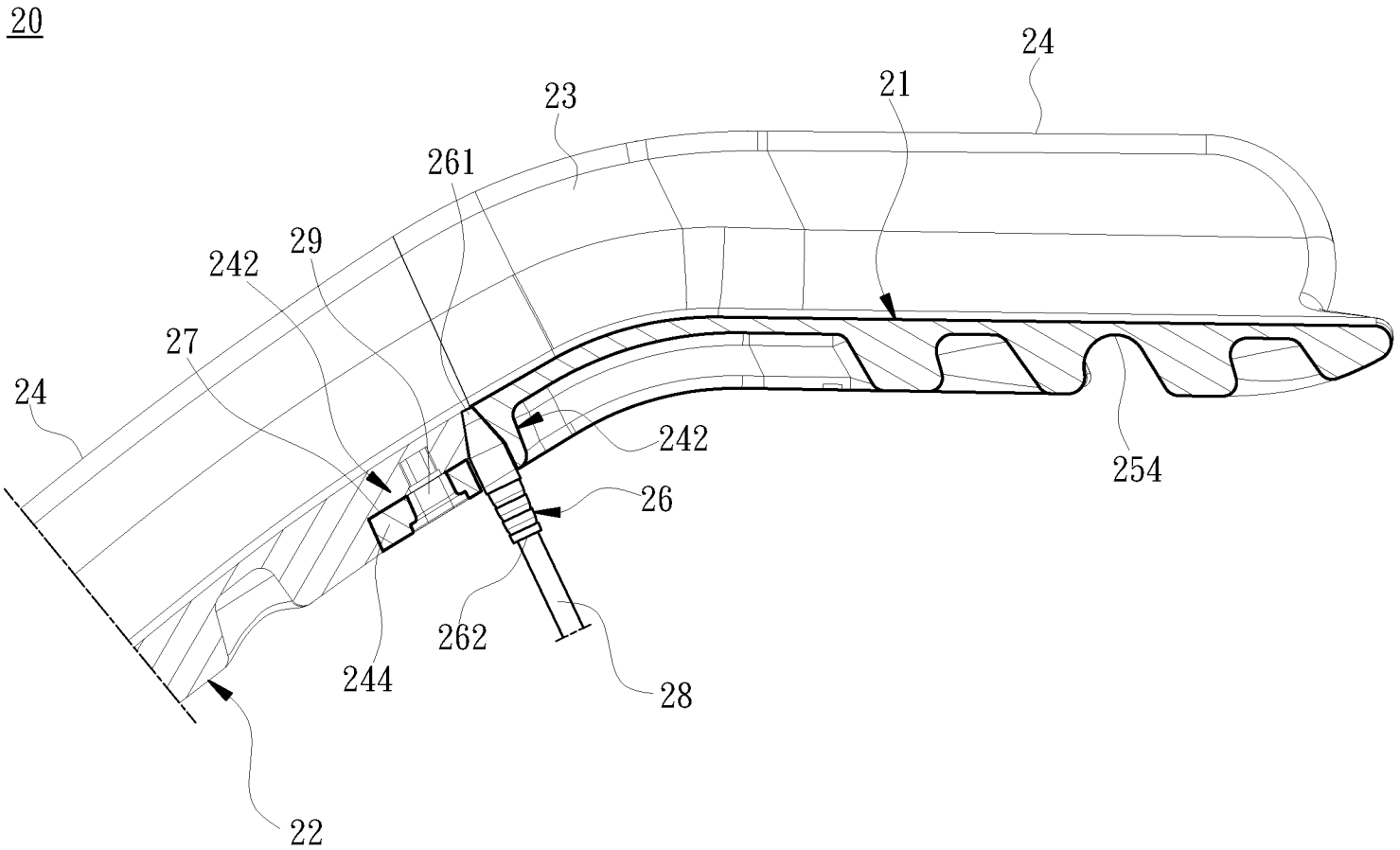
FIG. 6 is a cross-sectional view of a partial structure of the assembled slide of one embodiment of the invention with the water supply member.

Please refer to FIG. 2 and FIG. 3. In one embodiment, each of the two side plates 245 comprises a positioning groove 249, and the lapping portion 242 at other one of the two sub-units 24 as a part of the front 21 comprises at least two positioning blocks 250 matched with two positioning grooves 249, and the two positioning grooves 249 and the two positioning blocks 250 make a lapping relationship of the at least two sub-units 24 firmly.

Figure 7:
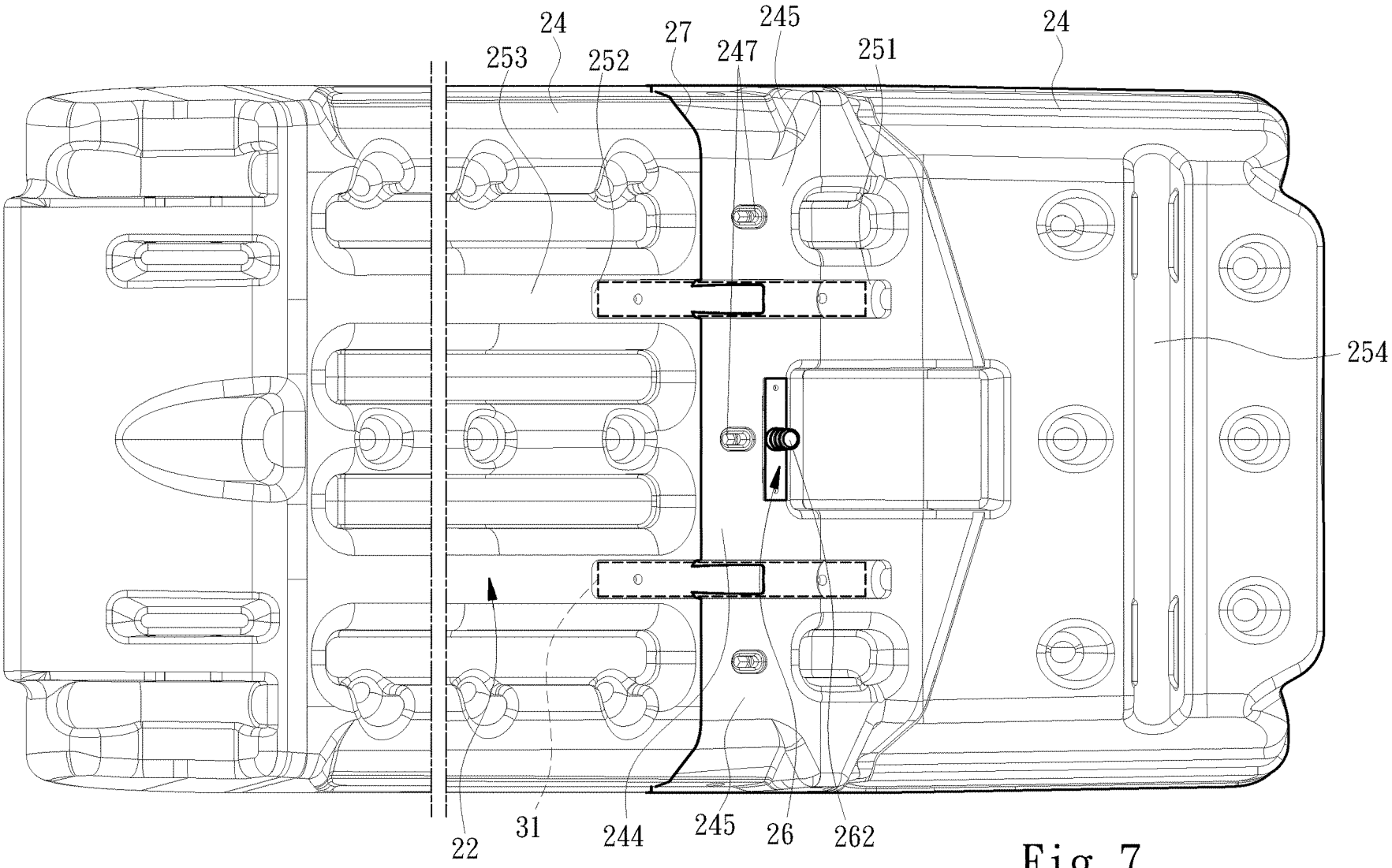
FIG. 7 is a schematic structural diagram of a slide back of the assembled slide of one embodiment of the invention.

Please refer to FIG. 3 and FIG. 7. In one embodiment, the lapping portion 242 at one of the two sub-units 24 as a part of the back 22 comprises two first grooves 251, wherein each first grooves 251 located between one of the two side plates 245 and the middle plate 244; and the lapping portion 242 at other one of the two sub-units 24 as a part of the front 21 comprises two second grooves 252. After the two lapping portions 242 of the two sub-units 24 are lapped with each other, the two second grooves 252 correspond and communicate with the two first grooves 251 respectively, and two auxiliary support rods 31 are respectively provided therein to strengthen a structural strength of the two lapping portions 242 after lapping.

Please refer to FIG. 7 again. In one embodiment, lengths of the two sub-units 24 are different, and one of the two sub-units 24 with a longer length comprises a plurality of support ribs 253 located on the back 22. The plurality of support ribs 253 are separately disposed on the back 22 at equal intervals, and the plurality of support ribs 253 are formed from one of the two sub-units 24 by blow molding. In addition, in one embodiment, the other one of the two sub-units 24 with a shorter length comprises a ladder mounting slot 254.

What is claimed is:

1. An assembly slide, defined with a front and a back, and two sides of the front provided with a retaining wall, wherein the assembly slide comprising at least two sub-units sequentially lapped with each other, and a water supply member, wherein each of the at least two sub-units comprises two ends, and at least one lapping portion disposed on one of the two ends, and wherein a lapped gap is formed after the at least two sub-units lapped with each other by two lapping portions thereof, and wherein the water supply member comprises a water outlet end exposed on the front and integrated with the lapped gap, and a water inlet end disposed on the back and connected to a water supply pipe.

2. The assembly slide as claimed in claim 1, wherein one of the two lapping portions at one of the at least two sub-units as a part of the back comprises an installation space communicated with the lapped gap and disposed of the water supply member.

3. The assembly slide as claimed in claim 2, wherein one of the two lapping portions at one of the at least two sub-units as a part of the back comprises a middle plate and two side plates respectively located on two sides of the middle plate, and the installation space is formed on the middle plate.

4. The assembly slide as claimed in claim 3, wherein each of the two side plates comprises a positioning groove, and the other one of the two lapping portions at the other one of the at least two sub-units as a part of the front comprises at least two positioning blocks matched with two positioning grooves of the two side plates.

5. The assembly slide as claimed in claim 3, wherein each of the middle plate and the two side plates comprises a first installation hole, and the other one of the two lapping portions at the other one of the at least two sub-units as a part of the front comprises a plurality of second installation holes matched with the first installation holes of the middle plate and the two side plates.

6. The assembly slide as claimed in claim 5, wherein one of the two lapping portions at one of the at least two sub-units as a part of the back comprises two first grooves, and each of the two first grooves is located between one of the two side plates and the middle plate, and wherein the other one of the two lapping portions at the other one of the at least two sub-units as a part of the front comprises two second grooves corresponding to the two first grooves respectively.

7. The assembly slide as claimed in claim 5, wherein lengths of the at least two sub-units are different, and one of the at least two sub-units with a longer length comprises a plurality of support ribs located on the back.

8. The assembly slide as claimed in claim 7, wherein the other one of the two sub-units with a shorter length comprises a ladder mounting slot.

* * * * *